US007847216B2

(12) United States Patent
Miura et al.

(10) Patent No.: US 7,847,216 B2
(45) Date of Patent: Dec. 7, 2010

(54) PANEL HEATER AND DISPLAY DEVICE USING THE SAME

(75) Inventors: Mitsuhiro Miura, Tokyo (JP); Shoji Kanesada, Tokyo (JP); Yuichiro Ohmae, Tokyo (JP)

(73) Assignee: Tpo Hong Kong Holding Limited, Shatin (HK)

( * ) Notice: Subject to any disclaimer, the term of this patent is extended or adjusted under 35 U.S.C. 154(b) by 680 days.

(21) Appl. No.: 11/578,699

(22) PCT Filed: Apr. 11, 2005

(86) PCT No.: PCT/IB2005/051168

§ 371 (c)(1),
(2), (4) Date: Oct. 10, 2007

(87) PCT Pub. No.: WO2005/101105

PCT Pub. Date: Oct. 27, 2005

(65) Prior Publication Data

US 2008/0041838 A1 Feb. 21, 2008

(30) Foreign Application Priority Data

Apr. 19, 2004 (JP) ..... 2004-122994

(51) Int. Cl.
*H05B 3/00* (2006.01)
*H05B 3/02* (2006.01)

(52) U.S. Cl. ..... 219/209; 219/538

(58) Field of Classification Search ..... 219/209, 219/210, 538, 541–548; 338/306–314; 349/161
See application file for complete search history.

(56) References Cited

U.S. PATENT DOCUMENTS 4,250,398 A * 2/1981 Ellis et al. ..... 219/549
4,331,860 A * 5/1982 Roller et al. ..... 219/544
4,885,457 A * 12/1989 Au ..... 219/548

FOREIGN PATENT DOCUMENTS

| | | | |
|---|---|---|---|
| EP | 1 202 107 | A2 | 5/2002 |
| GB | 2 361 775 | A | 10/2001 |
| JP | 5-127153 | A | 5/1993 |
| JP | 7-43746 | U | 9/1995 |
| JP | 2002-23186 | A | 1/2002 |

* cited by examiner

*Primary Examiner*—Sang Y Paik
(74) *Attorney, Agent, or Firm*—Birch, Stewart, Kolasch & Birch, LLP

(57) ABSTRACT

A panel heater includes: a heater main part including a substrate and an electric heating layer; an intervening terminal part including a base layer and a patterned conductive layer; and an anisotropic conductive film for coupling the heater main part and the intervening terminal part to electrically connect the electric heating layer to the conductive layer. The conductive layer is formed in a comb-shaped pattern including a plurality of tooth portions arranged in line at intervals and a portion connecting the tooth portions in common, the tooth portions being connected to the electric heating layer via the anisotropic conductive film, the intervening terminal part has a conducting wire-connective portion for connecting a power supply conductive wire to the conductive layer, and the electric heating layer and the conductive layer are made physically contact with each other via the anisotropic conductive film only by the tooth portions.

9 Claims, 6 Drawing Sheets

PANEL HEATER AND DISPLAY DEVICE USING THE SAME

TECHNICAL FIELD

The invention relates to a surface heater. The invention particularly relates to a panel heater used in a liquid crystal display panel or other panel assemblies and to a display device using the heater.

BACKGROUND ART

In a display device that may be used under circumstances where the device is forced to be driven at a low temperature in an airplane, automobile and the like, a panel heater has conventionally been used to heat the used display panel for a while after power-on of the device or if required, to get the operational temperature to an appropriate temperature. Particularly, in the liquid crystal material used as a display medium in a liquid crystal display panel, response characteristics and other display operational characteristics deteriorate under low-temperature circumstances, and so the material requires to maintain the operational temperature at an appropriate temperature by the panel heater.

Conventional techniques for such a panel heater include one described in Patent Document 1. In the panel heater described in the Document, a transparent conductive film is formed on a substrate, an electrode terminal to apply a voltage to the transparent conductive film is provided on a flexible wiring substrate, the electrode terminal and the transparent conductive film are pressure-bonded to be conductive via an anisotropic conductive material wherein conductive particles are mixed into an adhesive with the anisotropic conductive material sandwiched between the transparent conductive film and the electrode terminal, and the transparent conductive film is heated by applying a voltage to the transparent conductive film through the electrode terminal to warm liquid crystal display elements. Instead of forming the electrode terminal merely in the shape of a band with a constant width, the electrode terminal is provided on its edge portion with a plurality of inflow openings such that the anisotropic conductive material flows thereinto when the electrode terminal is pressure-bonded onto the transparent conductive film. By this means, the anisotropic conductive material is prevented from remaining at the edge portion of the electrode terminal, and the surface area of an end face on the edge-portion side of the electrode terminal, thereby improving the adhesion to the transparent conductive film.

[Patent Document 1] JP2002-23186 (see particularly, FIGS. 1, 2 and 6, Claims, and paragraph numbers [0015] to [0020], [0029], [0030], [0034] and [0035])

DISCLOSURE OF INVENTION

Technical Problem

However, the electrode terminal in the panel heater described in this Document has a principal portion other than the portions where the inflow openings are formed, and the principal portion is connected to the transparent conductive film via the anisotropic conductive material together with the edge portion having the inflow openings. Accordingly, the anisotropic conductive material is still hard to flow in the principal portion in the pressure-bonding. This respect might not become an issue depending on an applied pressure-bonding tool and/or method, but in consideration of manufacturing cost and other aspects, such a structure is required that the anisotropic conductive material is easy to flow in any pressure-bonding processes.

Further, there is no technical idea to overcome various problems likely occurring under large changes in temperature in the coupling form of the transparent conductive film and the flexible wiring substrate containing the electrode terminal as described in the Document. For example, any consideration is not taken into account with respect to an influence of mechanical stress or more due to a difference in thermal expansion (contraction) coefficient between the flexible wiring substrate as a power supplying member, and the transparent conductive film as an electric heating layer and the substrate.

The present invention has been made in view of the foregoing, its object is to provide a panel heater having a structure which enables anisotropic conductive material to easily flow when an electric heating layer serving as a main heating source of the heater and a power supplying member for the heating layer are pressure-bonded via an anisotropic conductive layer.

Another object of the invention is to provide a panel heater enabling easy flow of the anisotropic conductive material irrespective of pressure-bonding process.

A further object of the invention is to provide a panel heater allowed to overcome various problems likely occurring under extreme temperature changes, such as an influence of mechanical stress or more between the power supplying member and the electric heating layer. In particular, it is an object to provide a panel heater capable of maintaining reliable connection between the electric heating layer and the power supplying member for a longer time even when the temperature changes largely and frequently.

Technical Solution

In order to achieve the aforementioned objects, an aspect of the invention is a panel heater comprising: a heater main part comprising a substrate and an electric heating layer deposited thereon; an intervening terminal part including a base layer and a patterned conductive layer supported by the base layer; and an anisotropic conductive film for coupling the heater main part and the intervening terminal part to electrically connect the electric heating layer to the conductive layer, wherein: the conductive layer is formed in a comb-shaped pattern including a plurality of tooth portions arranged in line in a predetermined direction at intervals and a portion connecting the tooth portions in common, the tooth portions being connected to the electric heating layer via the anisotropic conductive film; the intervening terminal part has a conducting wire-connective portion for connecting a conducting wire for transmitting electric power to be supplied to the electric heating layer to the comb-shape-patterned conductive layer; and the electric heating layer and the conductive layer are made physically contact with each other via the anisotropic conductive film only by the tooth portions.

According to the structure where the commonly connective portion of the tooth portions is excluded from subjects of contact, when the intervening terminal part as a power supplying member is pressure-bonded onto the electric heating layer, the intervening terminal part faces the electric heating layer only at the tooth portions and gaps between the portions of the conductive layer via the anisotropic conductive layer. By this means, the anisotropic conductive film only flows into the gaps with the flow eliminated in the commonly connective portion of the tooth portions, the main flow in the gaps is not disturbed due to factors except the tooth portions, and it is thus possible to flow the anisotropic conductive material with extreme ease and uniformity.

In this aspect, the tooth portions may be divided into groups each constituted by a plurality of teeth, a space being provided between the groups, the space being larger than a distance between the tooth portions within a group. Since the tooth portions of the electric heating layer are thus divided into small blocks without being arranged uniformly, it is possible to make pressure-bonding for each of the divisional group of tooth portions, so as to be able to achieve good pressure-bonding using even small compression surface area. It contributes to the provision of manufacturing with large freedom, not depending on the manner of pressure-bonding process.

Further, it may be possible that the tooth portions are divided into groups each constituted by a plurality of teeth, and that the base layer has individual areas which support these groups respectively and are separated by a space. According to this structure, the base layer is also grouped corresponding to the groups of tooth portions, and it is possible to contribute to division of stress applied on the entire intervening terminal part. Therefore, even when there is an extreme difference in thermal expansion coefficient between the substrate and electric heating layer, and the intervening terminal part as a power supplying member, the mechanical stress between them is reduced as a whole, and it is possible to avoid deformation such as warpage, crack and flacking-off due to coupling of the intervening terminal part to the electric heating layer. Particularly, by extending the shape of the space outside the area of the electric heating layer (substrate), the electric heating layer is only coupled with front end portions of grouped portions of the intervening terminal part, the common portion extending in the entire intervening terminal part is not coupled to the electric heating layer at all, and therefore, the effect of division of stress further is intensified.

In the preferred form of grouping the tooth portions and base layer, a distance between one extreme edge of the tooth portions and the other extreme edge of the tooth portions in each group in a perpendicular direction to a longitudinal direction of the tooth portions may be equal to or less than a head width of a crimping surface area of a crimp head in the perpendicular direction, where the crimp head is used to crimp the intervening terminal part onto the heater main part via the anisotropic conductive film, or the number of tooth portions in each group may correspond to a distance equal to or less than a head width of a crimping surface area of a crimp head in the arrangement direction of the tooth portions, where the crimp head is used to crimp the intervening terminal part onto the heater main part via the anisotropic conductive film. By this means, the grouping is carried out suitable for the head face of a used pressure-bonding tool, so as to assure that one compression process by the head face reliably makes bonding of all the conductive-layer tooth portions and base layer of one group, and even using a pressure-bonding tool with a smaller head face achieves significantly excellent manufacturing.

Moreover, the substrate may be a glass substrate, the electric heating layer may consist mainly of ITO, connection of the conducting wire-connective portion may be based on soldering or other metal melting connection, and the base layer may be a flexible film substrate. Thus, each part or component and techniques can be applied which are the same as those conventionally used in the panel heater. It is worthy of note that the conductive wire to transmit the power to be supplied to the electric heating layer can be bonded to the intervening terminal part by metal melting connection such as soldering without any problems (or rather, with the advantages described above). In particular, by positioning the conducting wire-connective portion in the commonly connective portion of the conductive layer in the intervening terminal part, the advantages specific to the tooth portions and gaps thereof are not sacrificed.

Another aspect of the invention aims at a display device, and using the panel heater of the aforementioned aspect or each form to configure enables provision of a display device taking advantage of the panel heater as described above and/or described below.

BEST MODE

The aspects as described above and other modes of the present invention will specifically be described below by way of embodiments with reference to accompanying drawings.

Figure 1:
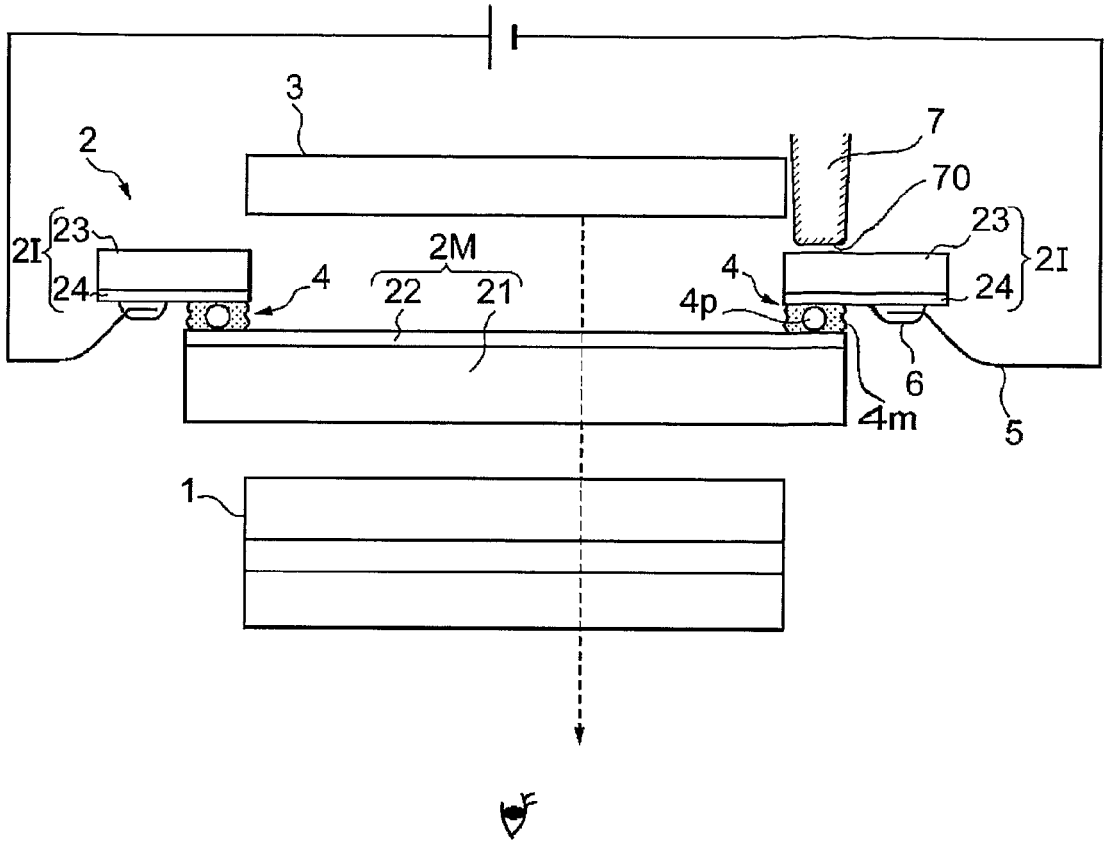
FIG. 1 is a cross-sectional view showing a general structure of a liquid crystal display device in one embodiment of the invention.

FIG. 1 shows in cross-sectional view a general structure of a liquid crystal display device according to one embodiment of the invention.

In FIG. 1, the liquid crystal display device mainly has a display panel 1 having a liquid crystal layer as a display medium and opposite substrates sandwiching the liquid crystal layer, a panel heater 2 disposed on the back side of the display panel 1 to heat the entire panel face, and a backlight (system) 3 disposed on the back side of the panel heater 2 to guide light to the display panel 1 through the panel heater 2. The display panel 1 has a configuration specific to the so-called transmissive type, not shown, in this embodiment, but is not necessarily limited to such a type of display device.

The panel heater 2 has a heater plate 2M as a plate-shaped heater main part comprising a substrate 21 for which a transparent glass substrate is used in this embodiment, and a transparent electric heating layer 22 made of a material such as ITO (Indium Tin Oxide) which is laminated on the entire surface of the substrate 21 to exhibit the electric heating effect. The heater main part 2M is provided with intervening terminal plates 2I at its opposite ends (in this embodiment, portions corresponding to left and right edges of the screen of the display panel). The intervening terminal plates 2I includes as a base layer, for example, a polyimide film substrate (FPC: Flexible Printed Circuit) 23, and a patterned layer supported by the substrate 23, which is a copper conductor 24 in this embodiment. Further, an anisotropic conductive film 4 exists between the heater main part 2M and the intervening terminal plate 2I. The conductive film 4 is to electrically connect the electric heating layer 22 and the conductor 24, while boding or fixing the heater plate 2M to the intervening terminal plate 2I, and is basically comprised of a base material 4*m* having adhesion property and conductive particles 4*p*, blended in the base material, consisting of nickel and/or other metal particles, or of metal plated particles with a predetermined core. An epoxy base resin that is a thermosetting resin is used as the base material 4*m* in this embodiment, but other resins are also applicable such as various thermoplastic resins and UV curable resins.

Figure 2:
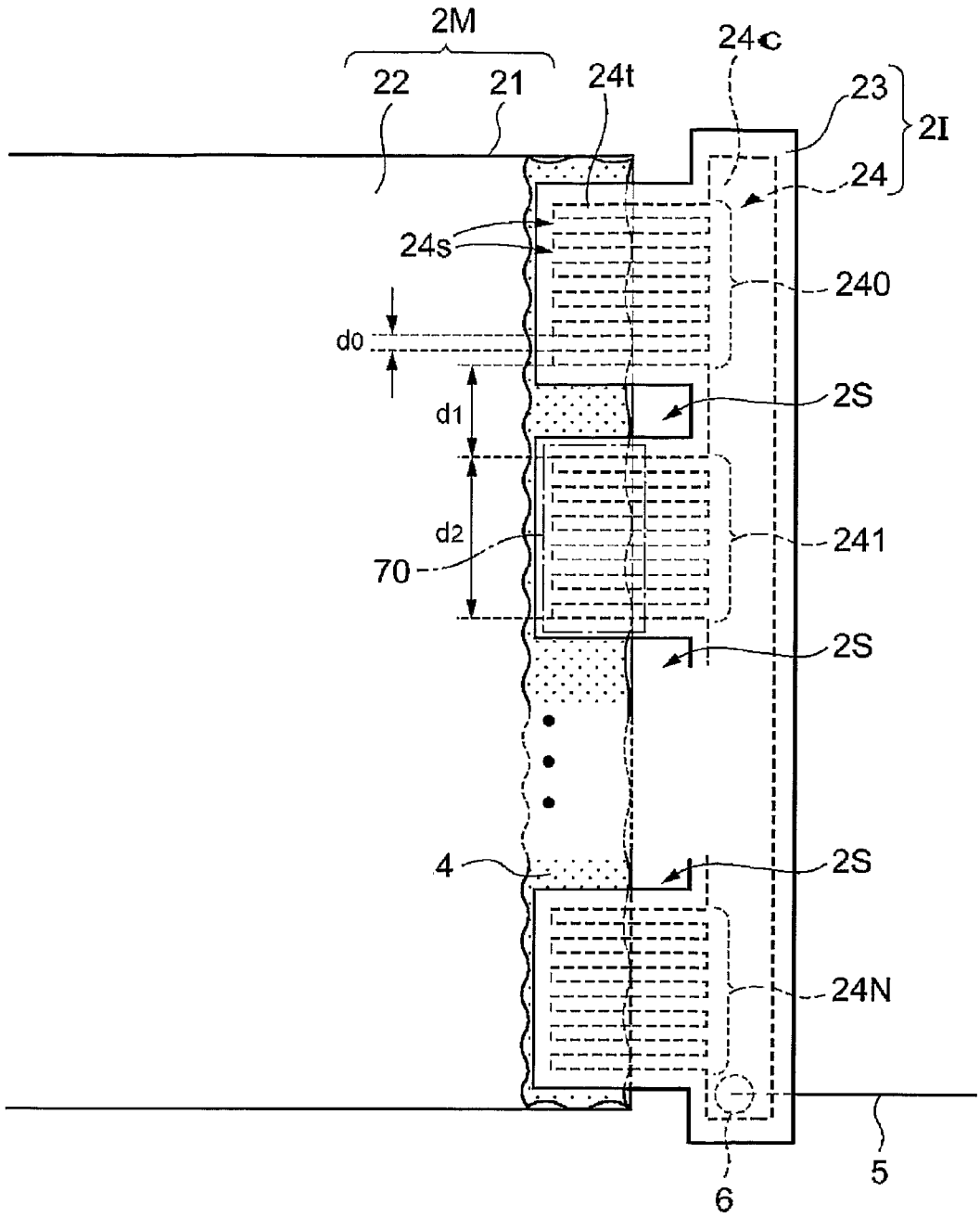
FIG. 2 is a schematic plan view showing a characterizing structure of a panel heater used in a liquid crystal display device in FIG. 1.

FIG. 2 shows a planar structure of the panel heater. As shown in the figure, the conductor 24 is formed in a comb-shaped-pattern including a plurality of tooth portions 24*t* spaced predetermined gaps 24*s* and located side by side in a predetermined arrangement direction (vertical direction as viewed in the figure, i.e. vertical direction on the screen of the display panel 1 in this embodiment), and a commonly connective portion 24*c* to connect the tooth portions. Each of the tooth portions 24*t* is connected to the electric heating layer 22 via the anisotropic conductive film 4. In addition, FIG. 2 shows only the planar structure of the panel heating portion on the right side in FIG. 1, and the same structure is applied to the left side.

The intervening terminal plate 2I has a wire connective portion 6 to connect a conductive wire 5 for transmitting electric power to be supplied to the electric heating layer 22 and the conductor 24 of the comb-shaped-pattern, at any part of the commonly connective portion 24*c*. The commonly connective portion 24*c* extends longitudinally to connect all the tooth portions 24*t* in this embodiment, and the wire connective portion 6 is formed at one end of the extending portion 24*c*. In this embodiment, the wire connective portion 6 is provided at one end of the commonly connective portion 24*c* in consideration of a combination with an applied display device. In order to uniformly transmit power, however, the portion 6 is preferably provided at opposite ends and/or a center of the commonly connective portion 24*c*, and may be situated in view of the circumstances of an applied display system and the like, as appropriate.

In this embodiment, the electric heating layer 22 and the conductor 24 come into physical contact with each other only by the tooth portions 24*t* via the anisotropic conductive film 4. In other words, the electric heating layer 22 does not come into contact with portions such as the commonly connective portion 24*c* of the conductor 24 except the tooth portions. Adopting such a structure that the commonly connective portion 24*c* is excluded from subjects of contact with the electric heating layer 22 expects the following effects and advantages:

When the intervening terminal plate 2I as a power supplying member is pressure-bonded onto the electric heating layer 22, the intervening terminal plate 2I opposes the electric heating layer 22 only at the tooth portions 24*t* and gaps 24*s* of the portions via the anisotropic conductive film 4. By this means, the anisotropic conductive film 4 generally flows into only the gaps 24*s* without flowing in the commonly connective portion 24*c*, and thus only the tooth portions 24*t* are factors to prevent the flow in the gaps 24*s*. This state will specifically be described with reference to FIGS. 3 and 4.

Figure 3:
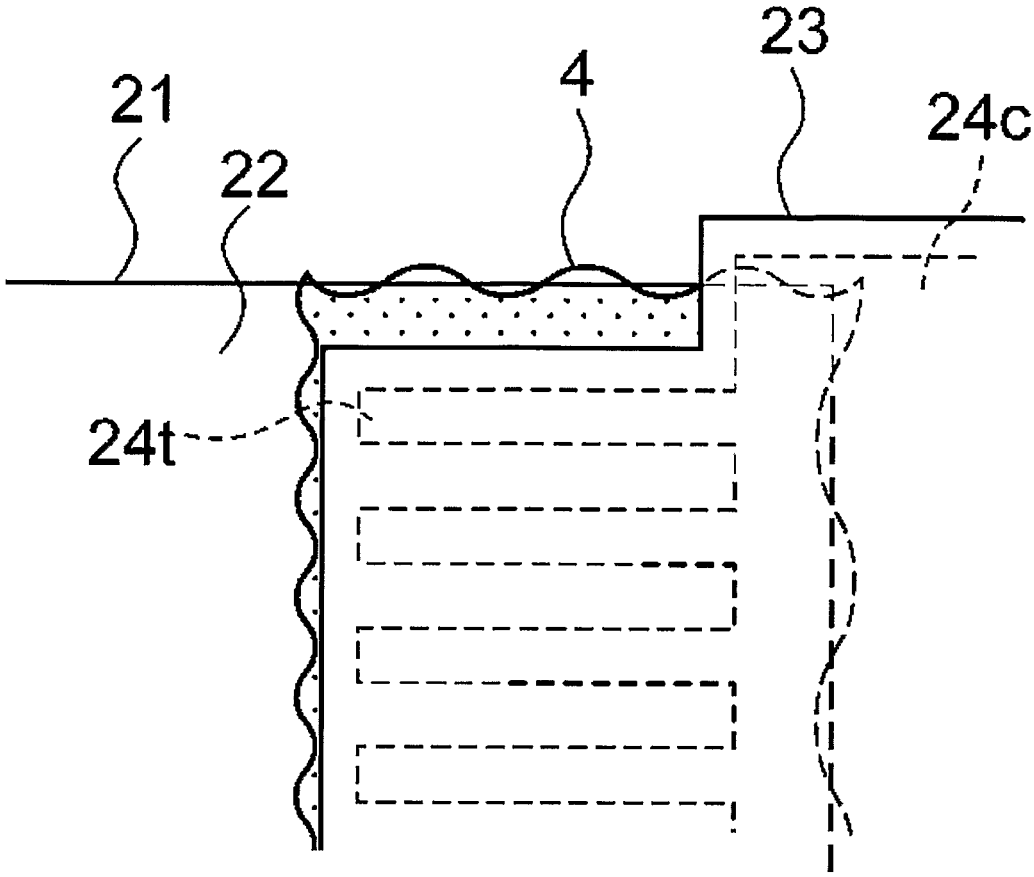
FIG. 3 is a plan view showing a comparison example for explaining effects and advantages of an embodiment of the invention.

As distinct from the form as shown in FIG. 2, FIG. 3 shows a comparative example where the commonly connective portion 24*c* is also opposed and pressure-bonded onto the electric heating layer 22 via the anisotropic conductive film 4 as well as the tooth portions 24*t* when the intervening terminal plate 2I is coupled to the heater plate 2M. It is understood that the edge of the electric heating layer 22 enters the area of the commonly connective portion 24*c* and overlaps therewith. The anisotropic conductive film 4 exists in the overlapping portion as in FIG. 2.

Figure 4:
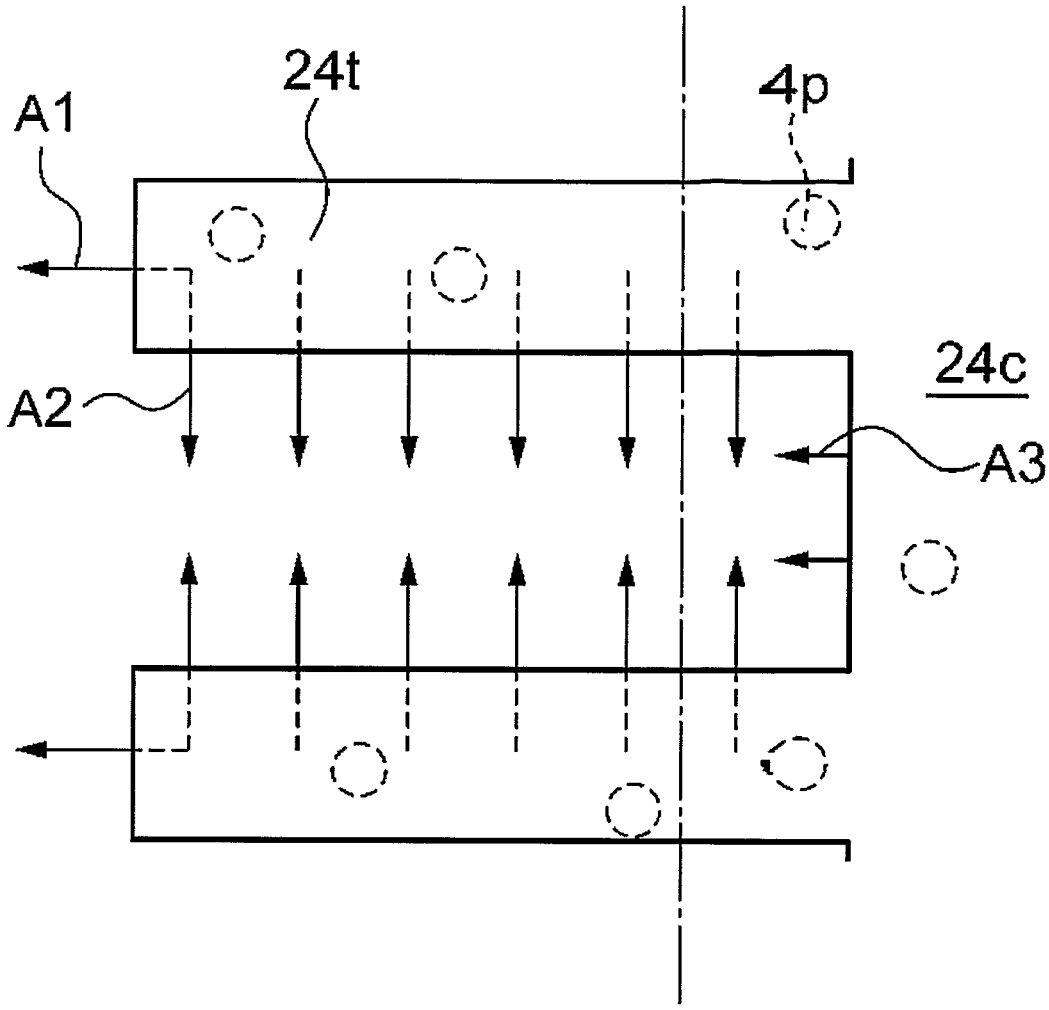
FIG. 4 is a schematic illustration showing a flowing state of an anisotropic conductive film in the comparison example of FIG. 3.

In such a way, the flow of the anisotropic conductive film 4 appears as shown in FIG. 4 in pressure-bonding of them. In other words, when the intervening terminal plate 2I is pressed to the heater plate 2M, the base material 4*m* and unnecessary conductive particles 4*p* of the anisotropic conductive film 4 between the tooth portions 24*t* and the electric heating layer 22 generally flow as shown by arrows in FIG. 4. According to such flows, the conductive particles 4*p* coming into contact with the tooth portions 24*t* and the electric heating layer 22 directly on their upper and lower portions are sandwiched between the portions 24*t* and the layer 22, resulting in physical mutual contacts thereof. Herein, for the sake of convenience, it can be considered that flow directions of the anisotropic conductive film 4 are schematically classified into a longitudinal direction of the tooth portions 24*t* as shown by the arrow A1, a traverse direction of the tooth portions 24*t* as shown by the arrow A2, and a direction perpendicular to the edge of the commonly connective portion 24*c* as shown by the arrow A3. Under such circumstances, as can be seen from FIG. 4, a portion appears where substances in the flow direction A2 collide with substances in the flow direction A3. Namely, the substances in the flow direction A3 interfere with the flow of part of the substances in the flow direction A2. Accordingly, in such a collision portion, the anisotropic conductive film 4 does not flow smoothly, or disturbances of the flow occur as compared with other relatively uniform flowing form. For this season, there is needed a pressure-bonding process with consideration of such a nonuniform flow.

In contrast thereto, in the way according to this embodiment as shown in FIG. 2, only the tooth portions 24*t* are opposed to the electric heating layer 22 and pressure-bonded onto the layer 22 via the anisotropic conductive film 4 to couple the intervening terminal plate 2I to the heater plate 2M. It is thereby possible to avoid the nonuniform flow as described above. In other words, there is no situation of flow directions in the right area about the alternate long and short dashed line shown in FIG. 4, but there is only flow directions in the left area. Accordingly, in this embodiment, it is possible to avoid nonuniformity of the flow due to the situation where the commonly connective portion 24*c* may be a target for pressure-bonding, and to achieve reliable pressure-bonding with high yield in a simpler pressure-bonding process.

The tooth portions in this embodiment are divided into groups with a plurality of tooth portions, and groups 240, 241, . . . , 24N are formed as shown in FIG. 2. Then, a gap d1 sufficiently larger than a distance d0 between tooth portions in a group is provided between the groups.

By this means, the tooth portions 24*t* of the conductor 24 are divided into small groups while a uniform arrangement over the whole is collapsed, and it is thus possible to take pressure-bonding for each of the divisional groups 240, 241, . . . , 24N of the tooth portions 24*t*, and even if the pressure-bonding tool 7 (see FIG. 1) has a small compression surface area 70, satisfactory pressure-bonding can be performed. A representative position of the compression surface area 70 is also shown in FIG. 2.

It should be noted that the gap d1 contributes to easy adjustment of a length of the intervening terminal plate 2I, that is the intervening terminal plate 2I may be cut at a portion of the gap d1 to adjust a length of the plate 2I, as well as to make each group suitable for the pressure-bonding tool 7. In other words, the gap can be used as a mark of a cutting position in visual check, mechanical position detection or the like for an operator or a machine tool. Further, it is possible to make a longer intervening terminal plate 2I first and then adjust a length of the intervening terminal plate 2I to be suitable for a size of an actually applied heater panel, whereby an advantage of improving the versatility thereof can be offered. The film substrate 23 in this embodiment has individual areas which support the groups 240, 241, . . . , 24N respectively, and spaces 2S are formed to isolate the individual areas.

According to this structure, the film substrate 23 is also grouped (divided into blocks or regions) corresponding to the groups 240, 241, . . . , 24N of the tooth portions 24*t*, and it is possible to contribute to division of stress applied on the entire intervening terminal plate 2I. It is general that a relatively large difference in thermal expansion coefficient exists between the heater plate 2M and the intervening terminal plate 2I. The substrate 21 and the electric heating layer 22 deposited thereon are higher in stiffness than the intervening terminal plate 2I having the film substrate as a base body. Under such circumstances, changes in temperature apply stress to both of them. Particularly, the intervening terminal plate 2I itself is low in stiffness, and therefore, it would store mechanical energy likely resulting in excessive warpage and/or distortion. Accordingly, when a large change is repeated in temperature, the stored mechanical energy may cause the intervening terminal plate 2I to have deformation such as warpage, crack and/or flaking-off that may not be restorable.

In this embodiment, the spaces 2S are provided to divide the intervening terminal plate 2I into regions, each of the divisional regions is coupled to the heater plate 2M, whereby the stress is divided, i.e. the storage of mechanical energy is dispersed. The stress applied on each of the divisional regions is thus reduced, and the intervening terminal plate 2I can be prevented from becoming deformed.

In addition, the space 2S does not necessarily require the form of extending outside the area of the electric heating layer 22 (substrate 21), but the form as shown in FIG. 2 is preferable. The electric heating layer 22 is only coupled with front end portions (generally half of the front end portions in FIG. 2) of grouped portions (corresponding to the groups 240, 241, . . . , 24N) of the intervening terminal plate 2I, while the common portion (corresponding to the commonly connective portion 24*c*) extending in the entire intervening terminal plate 2I is not coupled to the electric heating layer 22 at all, and therefore, the effect of division of stresses is further promoted.

Figure 5:
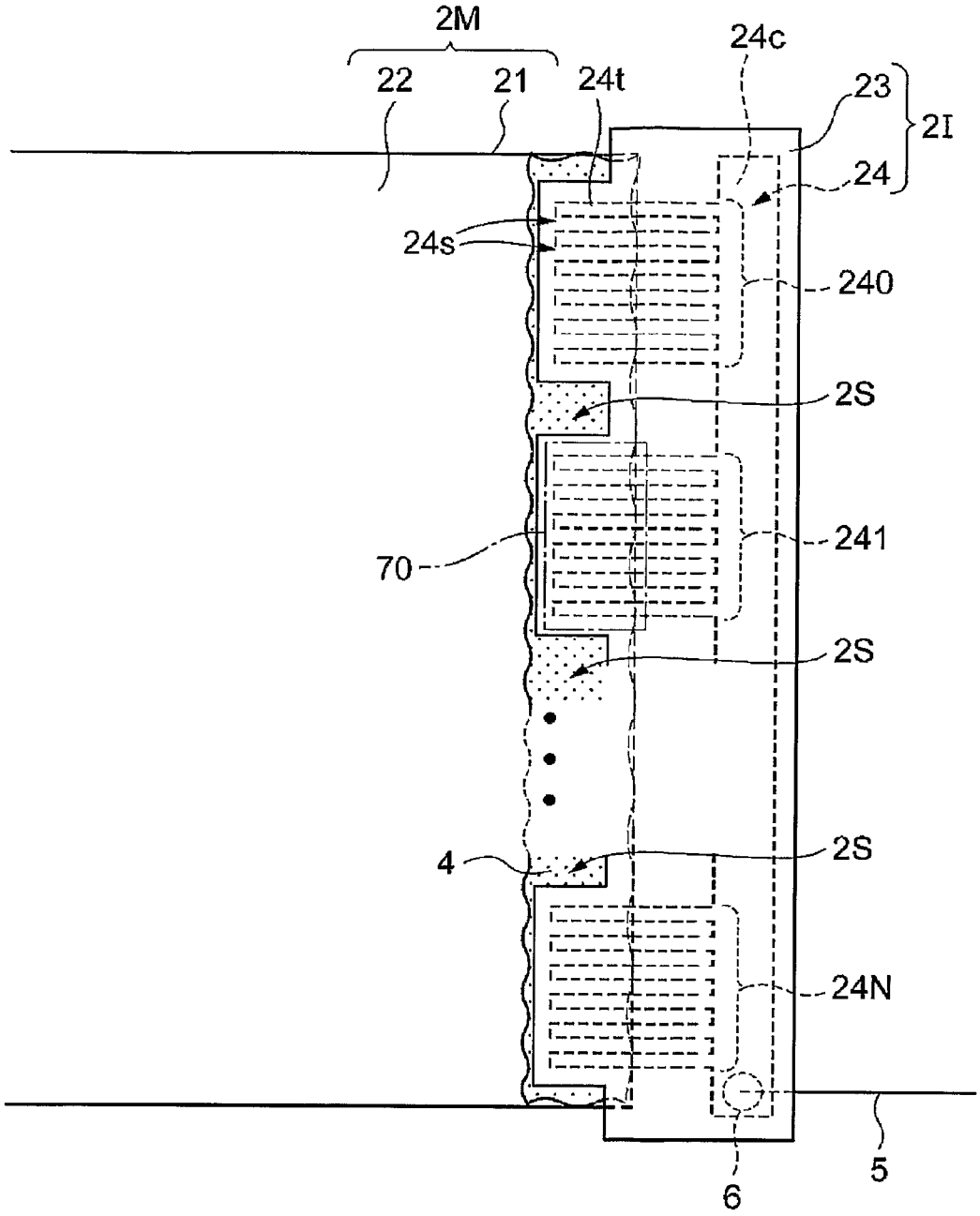
FIG. 5 is a schematic plan view showing a characterizing structure of a panel heater according to another embodiment of the invention.

Meanwhile, in the case where the space 2S is formed in a shape as shown in FIG. 5, i.e. the shape put in the area of the electric heating layer 22 (substrate 21), the effect of division of stress is reduced somewhat, but such an effect is expected to a certain degree. The example as shown in FIG. 5 is suitable for the case where the hollowing spaces 2S are not preferable for some reason when the heater plate 2M and the intervening terminal plate 2I are assembled as shown in FIG. 2.

The space 2S may not necessarily be in the form of a rectangle as shown in FIGS. 2 and 5. For example, the space 2S may be in the form of a V or triangle made by cutting the film substrate 21. In this case, the number of edges of the contour forming the space is reduced to two, making it easier to process the film substrate to form the space.

In order to achieve more reliable pressure-bonding, it is preferable that a distance d2 between extreme edges of the tooth portions 24*t* in a perpendicular direction to a longitudinal direction of the tooth portions 24*t* in each of the groups 240, 241, . . . , 24N is equal to or less than a head width of the compression surface area 70 of the compression head 7 in the perpendicular direction. When it comes to take another definition, it is preferable that the number of tooth portions 24*t* in each of the groups 240, 241, . . . , 24N corresponds to a distance equal to or less than a head width of the compression surface area 70 in the arrangement direction of the tooth portions 24*t*. By this means, the grouping is carried out suitable for the head face 70 of the compression tool 7 so that it is assured that one compression process by the head face reliably makes pressure-bonding of all the conductive-layer tooth portions and base layer of a single group. Accordingly, even using a pressure-bonding tool with a small head face enables excellent manufacturing. In order to perform pressure-bonding process using a single compression head or a plurality of compression heads of the same size, it is preferable that the distance between extreme edges or the number of tooth portions 24 is made the same in each of the groups.

In the aforementioned embodiment, as the substrate 21 and electric heating layer 22, wire connective portion 6 and the film substrate 23, the same materials as those generally used in a panel heater can be used, and it is not necessary to use parts and components that are particularly prepared.

The conductive wire 5 to transmit power to be supplied to the electric heating layer 22 is bonded to the intervening terminal plate 2I by soldering or metal melting substituting for the soldering. There is provided an advantage of avoiding direct connection of the conductive wire 5 to the heater plate 2M and preventing the conductive wire 5 from being removed from the heater plate 2M. Further, the wire connective portion 6 is positioned in the commonly connective portion 24*c* of the conductor 24 in the intervening terminal plate 2I, whereby the advantages specific to the tooth portions 24*t* and gaps 24*s* thereof are not sacrificed.

Figure 6:
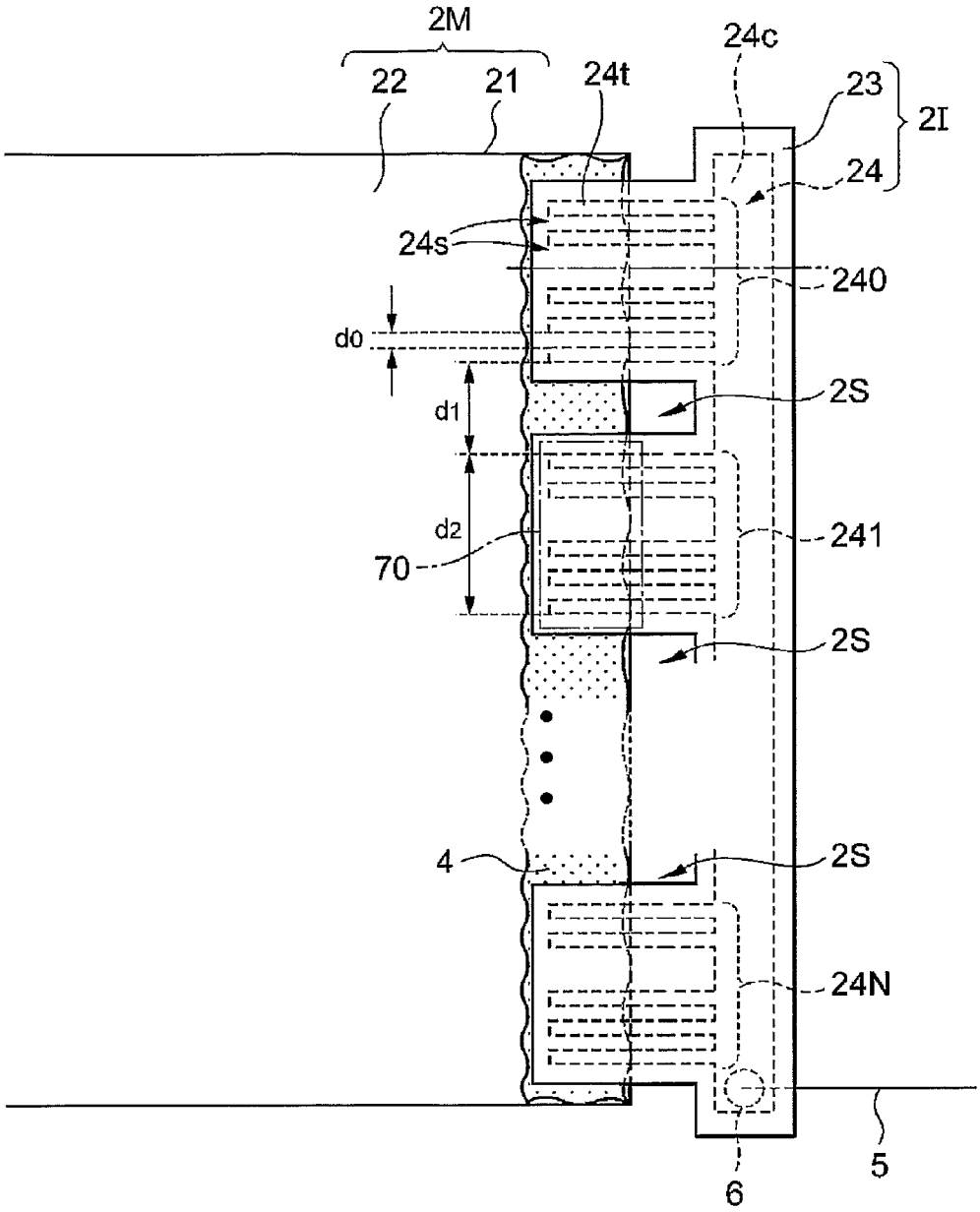
FIG. 6 is a schematic plan view showing a characterizing structure of a panel heater according to a further embodiment of the invention.

Another preferable embodiment is shown in FIG. 6. In the intervening terminal plate 2I shown in FIG. 6, a plurality of tooth portions 24*t* in each of the groups 240, 241, . . . , 24N are further grouped. In this embodiment, the tooth portions 24*t* are divided into a subgroup of two tooth portions 24*t* and another subgroup of three tooth portions 24*t*, and a gap between the subgroups is longer than the distance between the tooth portions. This form is to facilitate cutting of the film substrate 23 in a position between the subgroups (for example, a portion at an alternate long and short dashed line shown in FIG. 6). The advantage of such facilitation is basically the same as the above-mentioned advantage due to the gap d1, and there is contribution to a further improvement in functionality of providing a possibility that an area between the subgroups is removed to form a second space in the film substrate 23, as well as to finer length adjustment of the intervening terminal plate 2I and to pressure-bonding for each subgroup within the groups 240, 241, . . . , 24N.

In addition, each subgroup may have the same number of tooth portions or the same size, and/or two or more subgroups may be formed in one group.

A transmissive type liquid crystal display device is a subject of the aforementioned embodiments, but any types of display devices as well as any type other than the liquid crystal can be subjects irrespective of whether the device is of the reflective type or the transmissive type, and the present invention is applicable to any devices having the need of getting the operation temperature to an appropriate temperature over some area.

The representative embodiments of the present invention have been described in the foregoing, but the invention is not limited to the embodiments. It would be possible to find out various modifications within the scope of claims to those skilled in the art.

The invention claimed is:

1. A panel heater comprising:

a heater main part comprising a substrate and an electric heating layer deposited thereon;

an intervening terminal part including a base layer and a patterned conductive layer supported by the base layer; and an anisotropic conductive film for coupling the heater main part and the intervening terminal part to electrically connect the electric heating layer to the conductive layer, wherein:

the conductive layer is formed in a comb-shaped pattern including a plurality of tooth portions arranged in line in a predetermined direction at intervals and a portion connecting the tooth portions in common, the tooth portions being connected to the electric heating layer via the anisotropic conductive film; the intervening terminal part has a conducting wire-connective portion for connecting a conducting wire for transmitting electric power to be supplied to the electric heating layer to the comb-shape-patterned conductive layer; and the electric heating layer and the conductive layer are made physically contact with each other via the anisotropic conductive film only by the tooth portions, wherein the tooth portions are divided into groups each constituted by a plurality of teeth, and the base layer has individual areas supporting these groups respectively, the individual areas being separated by a space.

2. A panel heater as defined in claim 1, wherein the space is larger than a distance between the tooth portions within a group.

3. A panel heater as defined in claim 1, wherein a distance between one extreme edge of the tooth portions and the other extreme edge of the tooth portions in each group in a perpendicular direction to a longitudinal direction of the tooth portions is equal to or less than a head width of a crimping surface area of a crimp head in the perpendicular direction, where the crimp head is used to crimp the intervening terminal part onto the heater main part via the anisotropic conductive film.

4. A panel heater as defined in claim 1, wherein the number of tooth portions in each group corresponds to a distance equal to or less than a head width of a crimping surface area of a crimp head in the arrangement direction of the tooth portions, where the crimp head is used to crimp the intervening terminal part onto the heater main part via the anisotropic conductive film.

5. A panel heater as defined in claim 1, wherein the substrate is a glass substrate.

6. A panel heater as defined in claim 1, wherein the electric heating layer consists mainly of ITO.

7. A panel heater as defined in claim 1, wherein connection of the conducting wire-connective portion is based on soldering or other metal melting connection.

8. A panel heater as defined in claim 1, wherein the base layer is a flexible film substrate.

9. A display device using a panel heater according to claim 1.

* * * * *